United States Patent [19]

Tsuchiya et al.

[11] 4,073,520

[45] Feb. 14, 1978

[54] LATCH MECHANISM

[75] Inventors: Yoshimasa Tsuchiya, Sayama; Hiroshi Fujii, Niiza, both of Japan

[73] Assignee: Nissan Motor Company, Limited, Yokohama, Japan

[21] Appl. No.: 707,402

[22] Filed: July 21, 1976

[30] Foreign Application Priority Data

Aug. 31, 1975 Japan ..... 50-105275

[51] Int. Cl.[2] ..... E05C 3/26

[52] U.S. Cl. ..... 292/216; 292/DIG. 55

[58] Field of Search ..... 292/216, DIG. 41, 280, 292/DIG. 40, DIG. 55, 241

[56] References Cited

U.S. PATENT DOCUMENTS

| | | | |
|---|---|---|---|
| 3,386,761 | 6/1968 | Johnstone et al. | 292/216 X |
| 3,591,220 | 7/1971 | Sandor | 292/216 |
| 3,667,792 | 6/1972 | Torii | 292/216 |
| 3,709,537 | 1/1973 | Kazooka et al. | 292/216 |
| 3,767,243 | 10/1973 | Yoshimura | 292/216 |
| 3,844,595 | 10/1974 | Meinow | 292/216 |

*Primary Examiner*—Richard E. Moore
*Attorney, Agent, or Firm*—Frank J. Jordan

[57] ABSTRACT

A latch mechanism comprises a latch member having a latch portion having spaced recess walls defining a recess. One of the recess walls is disposed across a keeper bar receiving slot in the path of a keeper bar entering the slot for rotation of the latch member to a latch position against the force of a latch spring, while the opposite recess wall being positioned to move across the keeper bar receiving slot behind the keeper bar as the latch member moves to the latched position to confine the keeper bar within the slot. The opposite recess wall has a slanted face which when the latch member is in the latched position contacts with the keeper bar to urge the keeper bar into contact with one of parallel sides of the slot, to hold the keeper bar therebetween.

1 Claim, 6 Drawing Figures

FIG. 1
PRIOR ART
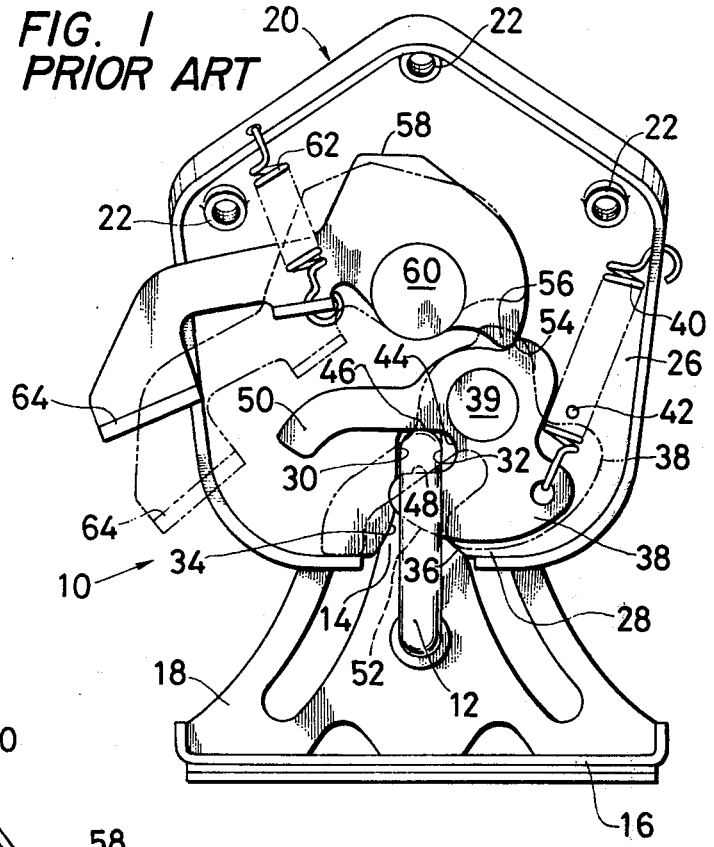
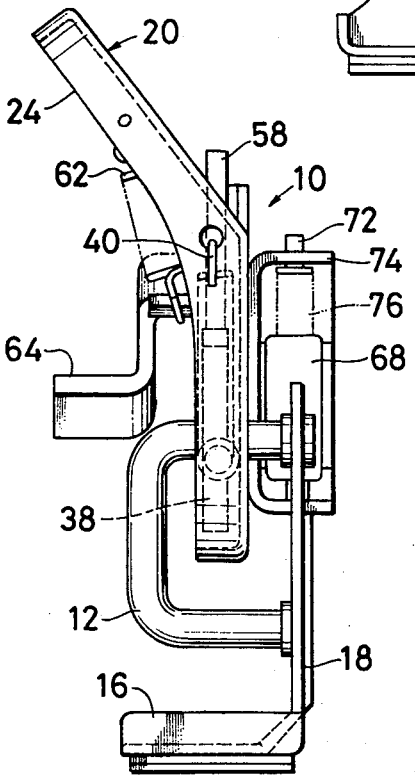
FIG. 2
PRIOR ART

LATCH MECHANISM

The present invention relates to a latch for latching a lid element of an automobile, such as an engine hood, a trunk lid, a tail gate, or a door element, such as a side door, a hatch back door, in closed position.

The important objects of the present invention are the provision of a latch of the type described which is constructed of few parts, is easy to assemble, and can be automated, is thin in cross-section so that it will project a minimum distance into the compartment to be closed.

Other objects and advantages of the present invention will appear from the following description and the accompanying drawings in which:

FIG. 1 is a view showing the parts of a latch of the prior art in latched position illustrated by solid line and in open or unlatched position illustrated by phantom line;

FIG. 2 is a view, as seen from the right on FIG. 1, of the latch;

Figure 3:
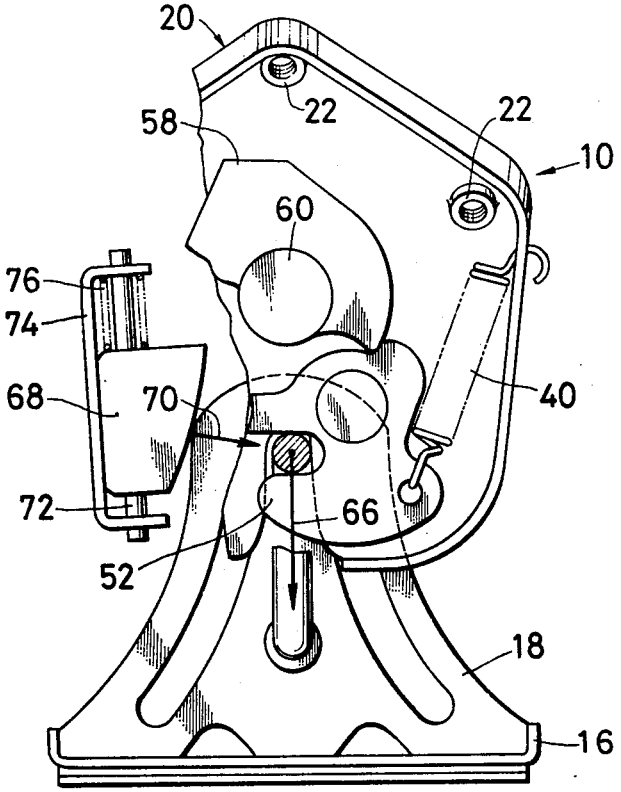
FIG. 3 PRIOR ART
FIG. 3 is a view partly broken away of the latch.

FIGS. 1-3 show a prior art latch 10, demonstrating how a keeper bar 12 is urged into contact with one of two parallel sides of a keeper receiving slot 14. The latch 10 comprise a base 16 fixed to a body element of an automobile body, both being not shown, and to the base 16 is secured the U-shaped keeper bar 12 having its ends fixed in the base 16 and its intermediate portion spaced from an upstanding section 18 of the base 16.

Although not shown a deck lid element overlaps the body element and a rubber seal is disposed between the deck lid and the body element. The deck lid is hinged to the body.

The latch member includes a latch plate indicated generally by the reference numeral 20 having openings therein 22 for affixing the plate to the lid with one side abutting the lid and the other side open or free of body obstructions, as by bolts, not shown.

The latch plate 20 comprises an attachment portion indicated at 24 having the openings 22, the plate 20 being formed with an area providing an intermediate mounting portion 26 and a keeper engaging portion 28.

The lower edge of the keeper engaging portion 28 is provided with the keeper receiving slot 14 having spaced substantially parallel side walls 30 and 32 spaced a distance slightly greater than the maximum width of the the keeper 12 for reception of the keeper therebetween within the slot. The slot 14 also has outwardly diverging walls 34 and 36 for guiding the keeper to the inner section as the keeper moves into the slot 14.

A latch member 38 is pivotally mounted on a pin 39 and comprises a flat piece of plate and is mounted in face to face relation with the intermediate portion 26 of the latch plate 20. The latch member 38 is rotatable between a latched position shown in solid line in FIG. 1 and an unlatched or open position as shown in phantom line in FIG. 1. The latch member 38 is normally urged to the open position by a helical spring 40. The latch member 38 has a shoulder 41 positioned to engage against an abutment 42 of the intermediate portion 26 to limit rotation of the latch member 38 in a counterclockwise direction about the mounting pin 39 and thereby define the open position of the latch member 38. The latch member has a latch section provided with a recess 44 defined by side wals 46 and 48 spaced a distance slightly greater than the maximum cross-section of the keeper 12, the recess forming two nose portions indicated by the numerals 50 and 52. The latch member 38 is mounted so that the latch section overlies the keeper engaging portion of the latch plate 20 with the recess 44 overlying the slot 14 in the keeper engaging portion 28 of the latch plate 20 as will be apparent from FIGS. 1 and 3.

In the open position of the lid the latch member 38 occupies the position shown by the phantom line in FIG. 1 wherein the nose portion extends 50 at an angle across the slot 14 of the plate 20 and the nose portion 52 is retracted so as to not obstruct the entrance of the keeper 12 into the slot 14. As the deck lid is moved toward a closed position the keeper 12 enters the inner section of the slot 14 and in the course of this movement engages against the wall 46 of the nose 50 thereby rotating the latch member 38 from the position illustrated by the phantom line in FIG. 1 to the position illustrated by the solid line in FIG. 1 whereupon the nose portion 52 moves in a clockwise direction to the position shown by the solid line in FIG. 1, disposed crosswise of the slot 14 in the keeper engaging portion 28 and acts to confine the keeper 12 within the slot 14. As the latch member 38 moves to the latched position shown by the solid line in FIG. 1 a shoulder 54 on the periphery of the latch member 38 moves past the end 56 of a detent 58 which drops behind the shoulder 54 to retain the latch member 38 in the latched position against the action of the spring 40 and any force which may be exerted between the keeper 12 and the latch member 38 tending to move the latch member to its open position.

The detent 58 comprises a flat plate mounted intermedite its ends on a pin 60 in coplanar relation to the latch member 38, the pin 60 being mounted in the latch plate 20. A helical spring 62 acts to urge the detent 58 in a clockwise direction so that the detent arm 56 normally rides the perimeter of the latch member 38. The detent 58 also has an actuating arm extending from the pin 60 in a somewhat opposite direction from that of the detect arm 56, the actuating arm having a bearing projection 64 adapted to be operated to move from the position shown by solid line in FIG. 1 to the position shown by phantom line in FIG. 1 against the action of the helical spring 62.

When the lid is in closed or latched position as shown by solid line in FIG. 1, rotating the detent 58 to the position shown by phantom line in FIG. 1 will release the latch member 38 for rotation to the position shown by phantom line in FIG. 1. Such rotation is brought about by the helical spring 40 which normally urges the latch member to this position. However when the lid is in closed position the rubber seal is normally somewhat compressed and consequently when the latch member 38 is released the keeper 12 moves downwardly with respect to the slot 14 in the latch plate 20 to a position such as to enable the spring 40 to rotate the latch member 38 until the shoulder engages the stop 42 thus completely releasing the keeper 12 from the latch member 38.

When the lid is in closed position the base 16 and the keeper 12 is biased downwardly with respect to the slot 14 due to the compression of the rubber seal as explained above, the keeper 12 firmly engages the nose portion 52 of the latch member 38 with a force indicated by an arrow 66 as shown in FIG. 3. In the closed position of the deck lid a wedge piece 68 engages the perimeter of the upstanding section 18 of the base 16 to urge the base 16 rightwardly with respect to the latch plate 20 as viewed in FIG. 3 thus preventing the base 16 and the keeper 12 from moving with respect to the latch plate 20 rightwardly or leftwardly as viewed in FIG. 3.

The wedge piece 68 is slidably mounted on a rod 72 mounted in a bracket 74 which is fixedly secured to the opposite side of the intermediate mounting portion from the side on which the latch member 38 is mounted as best seen in FIG. 2. The wedge piece 68 is positioned to abut the upstanding section of the base 16 when the deck lid is in closed position and a helical spring 76 mounted around the rod 72 and urging the wedge piece 68 downwardly with resepct to the rod 72 as viewed in FIG. 3 acts to urge the base rightwardly as viewed in FIG. 3.

Figure 6:
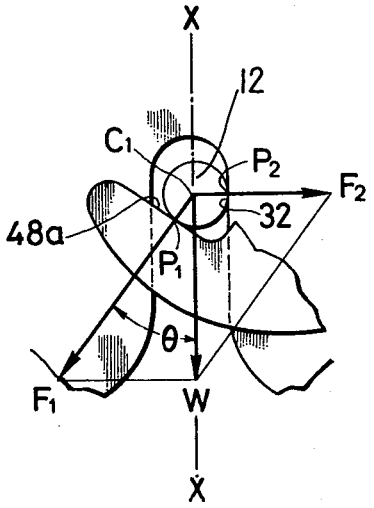
FIG. 6 is a view, as seen from the right on FIG. 4.
Figure 4:
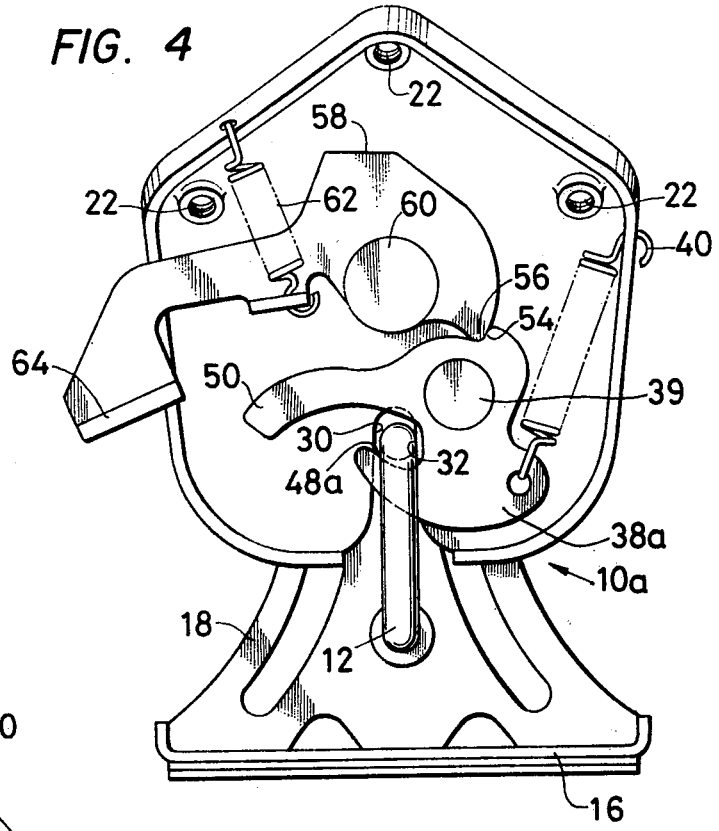
FIG. 4 is a view showing the parts of a latch according to the present invention in latched position.
Figure 5:
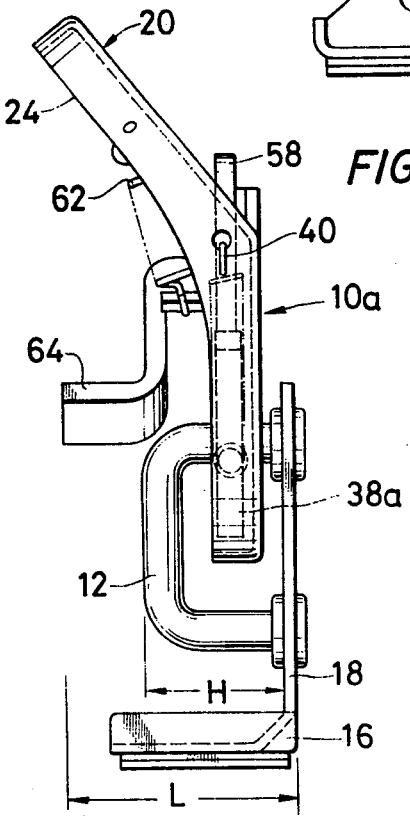
FIG. 5 is a diagram showing a vector diagram of a force applied to the keeper bar of the latch shown in FIG. 4.

FIGS. 4–6 show the improved latch 10*a* of the present invention in which the wedge piece 68, rod 72, bracket 74 and spring 76 are eliminated and the latch member 38 is replaced with a new latch member 38*a* with the other parts of the latch which are unchanged.

The new latch member 38*a* is best shown in FIGS. 4 and 6. It differs from the latch member 38 of the prior art latch 10 in that its recess wall to confine the keeper 12 within the keeper receiving slot 14 is not that of the latch member 38. The recess wall 48*a* which in cooperation with a recess wall 46 defines a recess 44*a* has a slanted face which is inclined with respect to a plane perpendicular to a line X—X (see FIG. 6) along which the keeper 12 moves when the deck lid is opened or closed. The slanted face is positioned to contact with the keeper 12 at a point $P_1$ (see FIG. 6) when the deck lid is in the closed position to urge the keeper 12 into contact with a side wall 32 of the keeper receiving slot 14, the contact point of the keeper 12 with the side wall 32 being indicated by $P_2$ (see FIG. 6), to interpose the keeper 12 therebetween.

In FIG. 6 a line connecting the point $P_1$ with the center $C_1$ of the keeper bar 12 forms an angle $\theta$ with the line X—X. When the deck lid is in closed position the keeper 12 is biased downwardly with respect to the keeper receiving slot 14 with a force W due to the compression of the rubber seal disposed between the deck lid and the body element. With this force W the keeper 12 is urged toward the recess wall 48*a* with a force $F_1$ and toward the side wall 32 with a force $F_2$. The forces $F_1$ and $F_2$ are the components of the force W and can be represented as follows:

$$F_1 = W/\cos\theta$$

where $\cos\theta = W/F_1$ $$F_2 = W.\tan\theta$$

where $\tan\theta = F_2/W$

It will now be appreciated that the latch 10*a* according to the present invention does not require, for urging the keeper 12 toward the side wall 32 of the keeper receiving slot 14, means corresponding to the wedge piece 68, rod 72, spring 76 and bracket 74 which is necessary in the prior art latch 10, and thus the latch according to the present invention has fewer parts, is easy to assemble and can be automated, is thin in cross section so that it will project a minimum distance into the compartment to be closed by the deck lid.

From the comparison of FIG. 5 with FIG. 2 it will be observed that the cross section L of the latch 10*a* according to the present invention has been reduced considerably by the elimination of the wedge piece 68 of the prior art latch 10 and it will also be observed that the height H of the keeper of the latch 10*a* has been reduced.

In the latch 10*a* according to the present invention it is desirable to reinforce connection between the keeper 12 and the upstanding section 18 of the base 16 so as to withstand the force $F_2$ applied to the keeper 12 when the deck lid is in closed position.

What is claimed is:

1. In a vehicle having a vehicle body;

a body element;

a member hinged to the vehicle body and overlapping said body element;

a compressible seal disposed between said body element and said member;

a keeper secured to one of said body element and said member;

a latch plate secured to the other one of said body element and said member, said latch plate having spaced walls defining a keeper receiving slot extending inwardly from the edge thereof, said walls defining an inner section having approximately parallel spaced sides for the reception of said keeper therebetween and a section having outwardly diverging sides for guiding said keeper to said inner section;

a latch member pivotally mounted on said latch plate for rotation between a latched and an open position;

a latch spring mounted on said latch plate urging said latch member toward the open position;

a detent pivotally mounted on said latch plate, said detent having a detent arm positioned to engage the perimeter of said latch member and an actuating arm;

a detent spring mounted on said latch plate urging said detent arm against the perimeter of said latch member;

said latch member having a latch portion, said latch portion having spaced recess walls defining a recess in an edge thereof, one of said recess walls being disposed across said keeper receiving slot in the path of said keeper entering said keeper receiving slot for rotation of said latch member to the latched position against the force of said latch spring in response to movement of said keeper into said keeper receiving slot, the opposite recess wall being positioned to move across said keeper receiving slot behind said keeper as said latch member moves toward the latched position to confine said keeper within said keeper receiving slot;

said opposite wall having a slanted face which is inclined with respect to a plane perpendicular to a line along which said keeper moves to provide an arrangement in which, when said member hinged to the vehicle body overlaps said body element, said compressible seal is compressed to bias said keeper within said keeper receiving slot toward said slanted face to urge said keeper into firm engagement with one of said approximately parallel spaced sides.

* * * * *